US005437173A

United States Patent [19]

Spinar

[11] Patent Number: 5,437,173

[45] Date of Patent: Aug. 1, 1995

[54] WINDOW LOCK WITH INDICATOR

[75] Inventor: Gary L. Spinar, Faribault, Minn.

[73] Assignee: Truth Division of SPX Corporation, Owatonna, Minn.

[21] Appl. No.: 19,099

[22] Filed: Feb. 18, 1993

[51] Int. Cl.[6] ..... E05B 41/00

[52] U.S. Cl. ..... 70/89; 70/432; 70/DIG. 59; 200/574; 292/64; 292/199; 292/201; 292/341.16

[58] Field of Search ..... 70/432, DIG. 59, 89; 292/201, DIG. 20, 112, 64, 65, 199, DIG. 47, 341.16; 200/574

[56] References Cited

U.S. PATENT DOCUMENTS

| | | | |
|---|---|---|---|
| 383,549 | 5/1888 | Wolcottt | 292/112 |
| 1,383,269 | 6/1921 | Eienberg et al. | 292/341.16 |
| 1,529,766 | 3/1925 | Bina | 70/432 |
| 2,036,151 | 3/1936 | Lang | 292/112 |
| 2,507,140 | 5/1950 | Bule | 200/574 X |
| 3,032,330 | 5/1962 | Stavenau . | |
| 3,109,675 | 11/1963 | Anderson . | |
| 3,145,040 | 8/1964 | Phelps | 292/304 |
| 3,394,955 | 7/1968 | Martin . | |
| 3,427,835 | 2/1969 | Jeffee | 70/432 |
| 3,670,128 | 6/1972 | Estrem | 200/574 |
| 3,706,467 | 12/1972 | Martin | 292/111 |
| 3,758,142 | 9/1973 | Gartner | 292/341.16 X |
| 3,811,718 | 5/1974 | Bates | 292/241 |
| 4,017,107 | 4/1977 | Hanchett | 292/341.16 |
| 4,050,724 | 9/1977 | Nakanishi | 70/89 X |
| 4,059,298 | 11/1977 | Van Klompenburg | 292/199 |
| 4,095,827 | 6/1978 | Stavenau | 292/65 |
| 4,095,829 | 6/1978 | Van Klompenburg | 292/241 |
| 4,213,642 | 7/1980 | Poe et al. | 70/432 X |
| 4,261,602 | 4/1981 | Anderson | 292/143 |
| 4,429,910 | 2/1984 | Anderson | 292/199 |
| 4,497,135 | 2/1985 | Vetter | 49/280 |

(List continued on next page.)

FOREIGN PATENT DOCUMENTS

| | | | |
|---|---|---|---|
| 29913 | 9/1907 | Austria | 70/432 |
| 2274982 | 11/1990 | Japan | 70/89 |

OTHER PUBLICATIONS

Truth Brochure entitled "Entrygard Sash Lock" (pp. 11–11a).

Truth Brochure entitled "Non-Handed, Low Profile Sash Lock" (pp. 12–12c).

Truth Brochure entitled "Sash Lock" (pp. 13–13a).

Truth Brochure entitled "Concealed Casement Hardware-Lock" (pp. 13.1–13.1b).

Truth Brochure entitled "Entrygard Cam Lock" (pp. 14–14 a).

Truth Brochure entitled "Low Profile Cam Lock" (pp. 17–17a).

*Primary Examiner*—Lloyd A. Gall

*Attorney, Agent, or Firm*—Wood, Phillips, VanSanten, Clark & Mortimer

[57] ABSTRACT

A lock for mounting on a window jamb for selectively grasping a keeper on a window sash to secure the sash closed against the jamb, including a base for mounting to the jamb and defining an open interior space along one side of the base, a rigid plate secured to the base adjacent the open interior space and including a guide slot therein, and a motor driven drive gear pivotable within the open interior space about a first axis. A pawl is secured to the drive gear at one end for pivoting about a second axis spaced from and substantially parallel to the first axis, and includes a keeper grasping portion at its other end. A guide pin projects from the pawl and is slidably received in the guide slot whereby rotation of the drive gear moves the keeper grasping portion of the pawl between the open position and the locking position. An indicator is pivoted in the base through engagement with a drive gear pin and the pawl during movement of the pawl to selectively position one of two visually different portions at a base window opening to visually display the position of the pawl. A paddle is movably mounted within the lock base open interior space, and a switch is operably connected to the paddle provides feedback to actuate power to the motor to move the pawl to the locking position when the paddle is engaged by movement of a keeper into the base open interior space.

11 Claims, 6 Drawing Sheets

U.S. PATENT DOCUMENTS

| | | | |
|---|---|---|---|
| 4,559,796 | 12/1985 | De Forrest, Sr. | 70/432 |
| 4,621,847 | 11/1986 | Paulson et al. | 292/199 |
| 4,623,179 | 11/1986 | Davis et al. | 292/64 X |
| 4,736,972 | 4/1988 | Mosch | 292/204 |
| 4,796,932 | 1/1989 | Tame | 292/112 |
| 4,801,164 | 1/1989 | Mosch | 292/204 |
| 4,813,725 | 3/1989 | Mosch | 292/241 |
| 4,848,809 | 7/1989 | Escaravage | 292/201 X |
| 4,948,183 | 8/1990 | Yamada | 292/199 |
| 5,110,165 | 5/1992 | Piltingsrud | 292/242 |
| 5,161,839 | 11/1992 | Piltingsrud et al. | 292/241 |
| 5,235,833 | 8/1993 | Pinto | 70/432 X |

WINDOW LOCK WITH INDICATOR

BACKGROUND OF THE INVENTION

1. Technical Field

The present invention is directed toward window locks, and more particularly toward sash locks.

2. Background Art

Window locks are known in the art and generally include a catch with a handle operator affixed to a window frame or jamb which interacts with a keeper on a corresponding section of a movable window sash to securely hold the sash tightly against the frame. Also known in the art are devices for sequential multipoint lock-up of the movable window sash with the window frame. These latter devices are locks which have a handle actuator interacting with a keeper at one point on a window frame and sash respectively which causes a second lock to engage a keeper at a distant location.

It has long been a desire that such locks be aesthetically pleasing, particularly in view of their positioning adjacent the outer edge of windows, which usually serve as visual focal points in any room. Therefore, such locks have often been designed to provide minimal intrusion into the field of vision provided by the window. However, it must be recognized that as less visual attention is directed to the lock, the risk that the lock might inadvertently be left open is increased. Therefore, it is desirable to provide such desired aesthetics without decreasing the practical safety and security intended to be provided by such locks.

Further, such window locks are often used in windows which also have operators which may be used by an occupant to open and close the window sash. In some cases, separate locks are provided and must be manually manipulated by the occupant separately from the operator. In other cases, combination structures have been provided whereby operation of the operator will also sequentially operate the locks. Such combination structures require mechanical connections between the operator and the lock, with such connections varying in complexity and expense. Several such structures are shown in commonly owned U.S. Pat. Nos. 4,497,135, 4,617,758, 5,054,239, and 5,152,103 as well as U.S. Pat. Nos. 27,119, 1,724,011, 1,748,662, 2,114,645, 2,136,812, 3,257,755 and EPO Application No. 323,241. Still other structures which have attempted to combine control of windows (or other closures) with locking of those windows, again with varying expense and mechanical complexity, have been shown in commonly owned U.S. Pat. No. 4,937,976, U.S. Pat. Nos. 2,538,980, 3,081,078, 3,145,988, 3,154,302, 3,202,414, 3,274,732, 3,653,154, 4,333,269, 4,860,493, West German Patent No. 1,176,021, German Patent No. 653,755, and Poland Patent No. 43,872.

Still further, it has previously been considered to provide locking structures which are not operated manually by an occupant of the room, but rather are operated by an electric motor or the like. For example, previously mentioned commonly owned U.S. Pat. No. 4,497,135 discloses an automatic operator and locking mechanism which is operated by an electric motor. However, it should be recognized that since there is no "hands-on" control of the mechanism by an individual, it might not be so easy for the occupant to recognize if the lock does not operate correctly or perhaps breaks during operation. In such a case, the occupant would have a false sense of the security being provided by the lock until such time as he somehow discovered the improper operation and/or broken component.

Also, in some windows (particularly larger size windows), it is desirable to provide multiple locks to ensure adequate locking of the sash to the frame. One such structure for providing such operation is shown in commonly owned U.S. Pat. No. 4,991,886. That device uses a slider connecting two spaced apart catches which can interact with keepers affixed to a window sash and linked together by a tie bar structure to establish a locked condition of the window. The movement of a handle actuator from its unlocked position causes an adjacent cam member on a catch to connect with a planar portion of an associated ramped keeper. The movement of the catch causes the slider, which has a length of movement along a path between the two keepers, to move the second cam member onto the planar section of the associated ramped keeper. Such multipoint window locks are somewhat limited, however, insofar as the tie bar interconnection imposes restrictions on the window frame configuration as well as limiting the relative positioning of the individual lock members.

The present invention is directed toward overcoming one or more of the problems set forth above.

SUMMARY OF THE INVENTION

In one aspect of the present invention, a lock is provided for mounting on a window jamb for selectively grasping a keeper on a window sash to secure the sash closed against the jamb. The lock includes a base for mounting to the jamb, a visible window opening in the base, a pawl movable within the base between open and locking positions, and an indicator movable between first and second positions when the pawl is moved between the open and locking positions. The indicator includes two visually different portions, one of the portions being visible through the window opening in the first position of the indicator and the other of the portions being visible through the window opening in the second position.

In a preferred configuration of this aspect of the present invention, a drive gear moves the pawl, and a pin on the drive gear engages a notch in the indicator to pivot the indicator when the pawl moves near one of its open or locking positions. Further, the notch disengages from the pin during movement of the pawl away from the one position when the indicator is between the first and second positions, and a cam portion on the pawl engages the indicator when the pawl moves from the open position to the locking position to move the indicator completely to the second position.

In a second aspect of the present invention, a lock includes a base for mounting to the jamb and defining an open interior space along one side of the base, a rigid plate secured to the base adjacent the open interior space and including a guide slot therein, and a drive gear pivotable within the open interior space about a first axis. A pawl is secured to the drive gear at one end for pivoting about a second axis spaced from and substantially parallel to the first axis, and includes a keeper grasping portion at its other end. A guide pin projects from the pawl and is slidably received in the guide slot whereby rotation of the drive gear moves the keeper grasping portion of the pawl between the open position and the locking position.

In a third aspect of the present invention, the lock includes a motor mounted to the lock base and drivably connected to the drive gear for pivoting the drive gear about the first axis, and means for actuating the motor to move the pawl from the open position to the locking position in response to movement of the keeper into the base open interior space. In a preferred configuration of this aspect of the invention, a movable paddle is provided within the lock base open interior space so as to be movable when engaged by a keeper. A switch is operably connected to the paddle whereby the switch shuts off power to an associated window operator and provides feedback to actuate the motor to move the pawl to the locking position when the paddle is engaged by movement of a keeper into the base open interior space.

It is an object of the invention to provide a window lock which may be easily manufactured and assembled, as well as easily installed in both retrofit and new construction installations.

It is another object of the invention to provide a window lock which will reliably and smoothly operate over the long expected life of a window unit.

It is a further object of the invention to provide a window lock which may be easily operated to lock and unlock a window sash from a window jamb, and a still further object of the invention to provide a window lock which can be automatically operated appropriately in coordination with the position of the window sash.

It is a still further object of the invention to provide reliable security in a window having the present lock whereby an individual may be able to reliably determine the locking condition of the lock.

BRIEF DESCRIPTION OF THE DRAWINGS

FIG. 1 is a partial perspective view showing a window jamb and sash with a keeper and the window lock of the present invention;

DESCRIPTION OF THE PREFERRED EMBODIMENT

Figure 2:
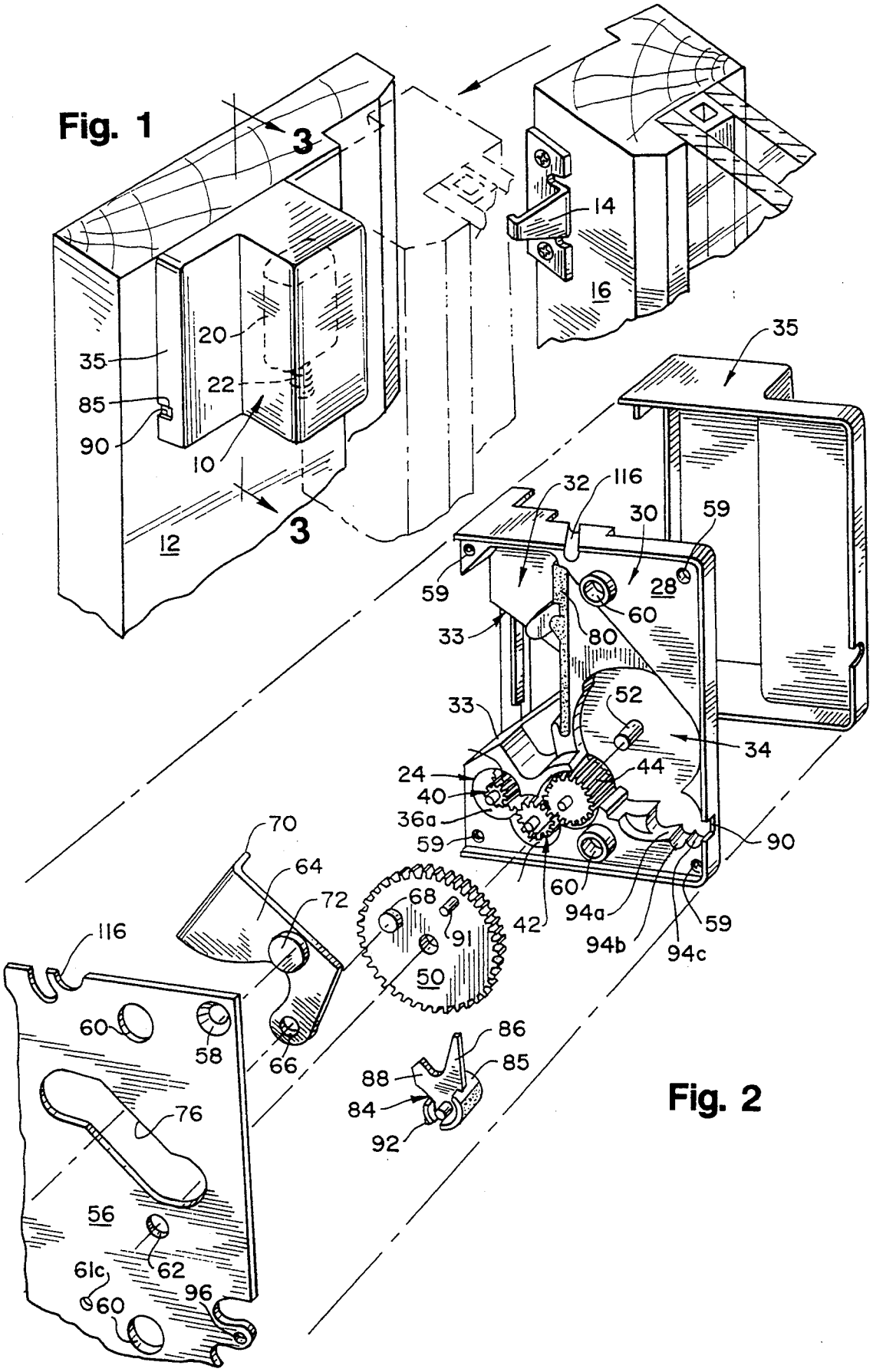
FIG. 2 is a perspective exploded view of the window lock of the present invention.

The window lock 10 of the present invention is shown in FIG. 1 installed on a window frame or jamb 12. As described hereafter, the window lock 10 cooperates with a suitable keeper 14 fixed to the window sash 16 for securing the window jamb 12 and sash 16 together when closed.

Typically, the sash 16 is mounted for pivotal movement with respect to the window frame 12 between an open position allowing fresh air through the window opening (and, in some installations, to allow egress through the opening and/or access to the outside of the window for cleaning) and a closed position protecting the interior of the dwelling from inclement weather. In the closed position, it is desirable to include a lock not only to ensure that the sash 16 is properly closed to provide a fight weather seal but also to provide security against intruders.

Depending on the size of the window sash 16, it can be desirable to provide more than one such lock 10 in order to ensure that a tight and secure seal is provided between the jamb 12 and sash 16 about their entire periphery. Therefore, while only one such lock 10 is shown herein, it should be understood that several such locks 10 may be advantageously used in such an installation as further described below.

Further, it is preferable that the lock 10 of the present invention be used in combination with a suitable operator (not shown) which controls movement of the sash 16 relative to the jamb 12. In the preferred embodiment, such operator is electrically controlled and driven in cooperation with the lock 10 disclosed herein, although it should be understood that locks embodying the improvements of the present invention could in some installations be used in combination with manual window operators or even with windows having no such operators at all.

The lock 10 of the preferred embodiment of the present invention includes a DC motor 20 (see FIG. 1) to drive the lock 10 between its open and locking positions. The DC motor includes an output worm 22 (see FIG. 1 ) which engages a gear reduction drive 24 as described hereafter to operate the lock 10.

The lock 10 includes a base 28 to which the motor 20 is suitably mounted (the motor 20 being mounted to the top of the base 28 and thus not seen in FIG. 2). As shown in detail in FIG. 2, the base 28 defines a bottom open interior space 30 including a keeper receiving chamber 32 and a drive chamber 34.

The keeper receiving chamber 32 preferably includes tapered side walls 33 which function as a sash lifter which compensates for sash sag, where present, by engaging the keeper 14 to lift and align the window sash 16 as it is being locked. Sash sag is particularly common in older windows, and thus this structure makes the lock 10 well suited for use in retrofit applications. Of course, this structure is useful even in new installations, given the expected useful life of windows and the reality that sash sag will ultimately develop in many of those windows.

A lock housing 35 is suitably secured over the base 28 and its below described components to both protect the lock components and also for aesthetics of the lock 10. As will be appreciated by those skilled in this field, the illustrated housing 35 is of a shape which is similar to the framing about many window jambs and which can therefore be installed in such jambs with minimal intrusion into the visual aesthetics of the window.

The drive chamber 34 includes suitable bores **36*a–c* formed from the bottom of the base 28, each of the bores 36*a–c* including a pivot shaft 38*a–c* suitably secured at the central axis thereof. The gear reduction drive 24 includes four gear clusters or sets, only two of which are visible in the drawings. Specifically, a first gear set (not seen) is rotatably mounted on pivot shaft 38***a* and includes a suitable helical gear which engages the motor output worm 22 and rotates about the shaft 38*a* with a relatively small diameter gear. A second gear set (also not seen) is rotatably mounted on pivot shaft 38*b* and includes a relatively large diameter gear portion engaging the small diameter gear of the first gear set and a relatively small diameter gear portion.

A third gear set 40 (seen best in FIGS. 3–6) is rotatably mounted on pivot shaft 38*a* and includes two gear portions 40*a*, 40*b*, with the relatively large diameter gear portion 40*a* engaging the small diameter gear portion of the second gear set. A fourth gear set 42 is rotatably mounted on pivot shaft 38*b* and also includes two gear portions 42*a*, 42*b*, with its relatively large diameter gear portion 42*a* engaging the small diameter gear portion 40*b* of the third gear set 40. The relatively small diameter gear portion 42*b* of the fourth gear set 42 engages an idler 44 which is rotatably mounted on the pivot shaft 38*c* in the third bore 36*c*. The idler 44 drives a drive gear 50 mounted for pivoting about a pivot pin 52 in the base 28.

The drive 24 thus operates to provide significant speed reduction and related power increase within a very limited space. Space limitations are, of course, significant with window locks given the unacceptability of bulky and/or visually intrusive structures. Further, it should be understood that assembly of these gears is very simple, as the gear sets can be easily assembled in the base 28 in a simple sequence (first put the first gear set on pivot shaft 38*a*, then the second gear set on pivot shaft 38*b*, then the third gear set 40 on pivot shaft 38*a*, then the fourth gear set 42 on pivot shaft 38*b*, then finally idler 44 and drive gear 50). Still further, it should be appreciated that the gear reduction obtained from the drive 24 may be easily varied by substituting different gear sets within the same basic lock structure.

A bottom plate 56 is suitably secured to the base 28 by screws 57 (seen in cross-section only in FIGS. 3–6) through openings 58 in the bottom plate 56 received in threaded openings 59 in the base 28 (see FIG. 2). Aligned screw holes 60 are also provided through both the base 28 and the bottom plate 56 for mounting screws (not shown) to secure the lock 10 to the window jamb 12. Preferably, the screw holes 60 are oriented to align with the jamb holes typically used to mount prior art locks, so that this lock 10 could be easily installed in retrofit applications.

Further, the bottom plate 56 (see FIG. 2) disposed over the open interior space 30 during the final steps of assembly securely maintains the gear sets in their proper positions without requiting any special assembly steps to otherwise secure the gears. This not only simplifies assembly, but also allows for easy maintenance of the drive 24 should it be necessary to remove and/or replace any of the gear sets. Still further, in the preferred embodiment of the present invention, the bottom plate 56 not only maintains the gears on their shafts 38*a–c*, but also includes openings therein (see 61*c* in FIG. 2) corresponding to the pivot shafts 38*a–c* to ensure centering of the shafts 38*a–c* in their respective bores 36*a–c* and thereby ensure smooth operation of the gear sets about the shafts 38*a–c*. Similarly, an opening 62 corresponds to pivot pin 52 to ensure proper alignment of all components.

A pawl 64 includes a cylindrical opening 66 at one end, and is pivotally secured to a pin 68 projecting from the drive gear 50. The pawl 64 may thus be pivoted relative to the drive gear 50 about an axis radially spaced from but substantially parallel to the axis of the drive gear pivot pin 52 as described in greater detail hereafter.

The end of the pawl 64 opposite the opening 66 is bent at substantially 90 degrees relative to the rest of the pawl 64 so as to define a keeper grasping portion 70. A guide pin 72 is provided intermediate the ends of the pawl 64, which guide pin 72 is received in a guide slot 76 in the bottom plate 56 so that movement of the pawl 64 is as described hereafter.

A suitable cushion stop 80 is preferably provided in the base 28 (see FIGS. 2–6) and is engaged by the keeper grasping portion 70 of the pawl 64 when the pawl 64 reaches its open position as described hereafter. Preferably, the stop is formed of a durable hard rubber or plastic material to provide a small amount of give when the pawl 64 reaches that position.

An indicator 84 is also pivotally secured in the base 28, and includes a hub 85 from which a pair of V-oriented legs 86, 88 extend to form a notch therebetween. The indicator hub 85 includes a cylindrical outer surface broken into two visually different portions (preferably, one portion is black and the other portion is red) which are selectively oriented to be seen through a window opening 90 in the base 28 to thereby provide a visual indication of the condition of the lock 10 as described in further detail below. Part of the movement of the indicator 84 is controlled by engagement of a indicator pin 91 on the drive gear 50 with the hub notch as described below.

The indicator 84 also includes a suitable detent 92 on the hub 85, which detent 92 cooperates with three detent notches 94*a–c* in the base 28 to provide three discrete positions for the indicator 84. In the preferred embodiment of the present invention, the indicator 84 is formed of a suitable hard plastic material or the like, with an upright flange provided on the hub 85 so that the detent 92 may flex radially inwardly somewhat relative to the pivot axis of the hub 85 when the indicator 84 is moved from one position to the next as described below.

The bottom plate 56 includes an opening 96 corresponding to the pivot of the indicator hub 85 to ensure its proper orientation for pivoting.

A paddle switch 100 is supported in the base 28 for pivoting about a transverse axis. The paddle switch 100 includes a downwardly depending paddle 102 near the front of the keeper receiving chamber 32, and further includes a radially extending arm 104 near one end. The switch arm 104 is engaged by one end of a coiled spring 108, the other end of which is seated on the base 28. The spring 108 operates to bias the arm 104 into engagement with the plunger 110 of a control switch 112.

The control switch 112 is suitably connected to a control circuit (described below), and the motor 20 is suitably connected to a power source, by wiring hidden in the window jamb 12 for aesthetic purposes as well as to protect the wiring. Therefore, in the preferred embodiment of the present invention, a suitable slot 116 is provided on one side of the base 28 and the bottom plate 56 for passage of any necessary power and control cables from the bottom of the lock 10 (adjacent the window jamb 12) to the top of the base 28 (where the motor 20 and control switch 112 are located).

Figure 10:
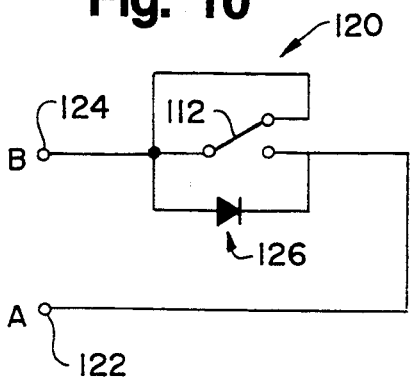
FIG. 10 is a diagram of a portion of the power circuit for an operator motor with which the lock of the present invention may be sequentially operated.
Figure 9:
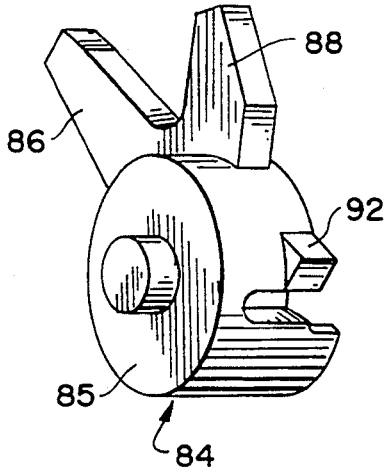
FIG. 9 is a perspective view of the indicator of the present invention.

A portion of a suitable control circuit 120 which may be advantageously used when the above described lock 10 is used in combination with a motor driven operator is shown in FIG. 10. Specifically, a suitable control is provided for cycling of the operator and lock as desired, and the circuit portion 120 illustrated in FIG. 10 is in series in the portion of that control which comprises the power circuit for the operator motor.

When the control switch 112 is closed (i.e. , there is no keeper 14 in the lock 10 and thus the paddle switch arm 104 depresses the switch plunger 110), the switch 112 permits current to pass from positive at terminal A 122 to negative at terminal B 124 to drive the operator motor in a direction which closes the window sash 16.

Once the window sash 16 is closed sufficiently so that the keeper 14 engages the paddle switch 100 to change the control switch 112 to the position shown in FIG. 10, the circuit to the operator motor is shut off as the current cannot pass through the diode 126 with positive being at terminal A 122.

When reverse operation of the operator motor is subsequently desired to open the window sash 16 after the lock 10 has been opened, current is supplied with positive at terminal B 124 and negative at terminal A. In this reverse configuration, even though during initial operation the switch 112 is still open as shown in FIG. 10, the current can nevertheless pass through the diode 126 and drive the operator motor to open the sash 16.

Though not shown herein in detail, it will be understood by those skilled in this art that any variety of control structures can be used with the lock 10 of the present invention, which control structures could not only operate the lock and operators in the desired sequence as discussed above, but also could sequentially operate multiple locks in a single window (in such a case, it would generally, for example, be desirable to first operate the lock disposed nearest to the operator structure since its keeper is more reliably disposed within the lock as required for proper operation).

Operation of the preferred embodiment of the lock 10 of the present invention is thus as follows.

Figure 8:
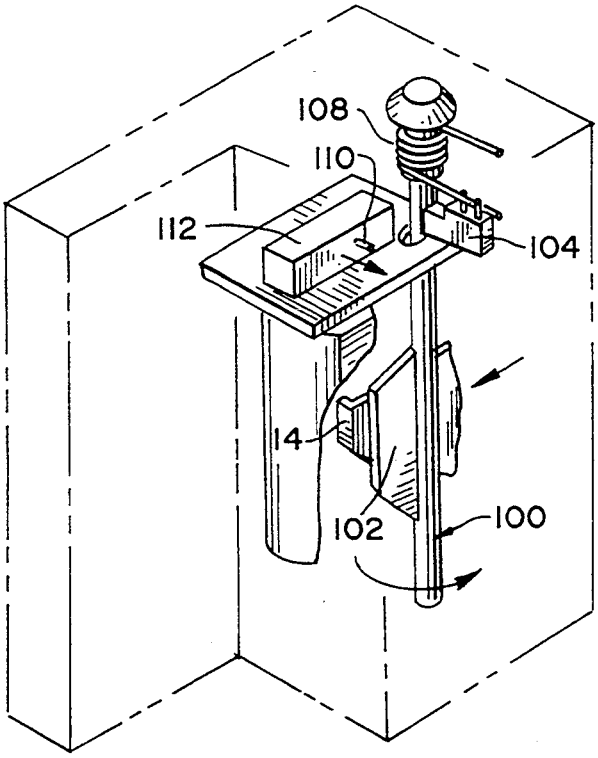
FIG. 8 is a view similar to FIG. 7, but showing the paddle switch as positioned with the sash keeper disposed in the lock.

As the sash 16 closes against the jamb 12, the keeper 14 enters the keeper receiving chamber 32 of the lock 10, engaging and pivoting the paddle switch 100 as shown in FIG. 8. Pivoting of the paddle switch 100 disengages its arm 104 from the plunger 110 of the control switch 112 which then provides feedback indicating this position of the sash 16 to the control circuit 120 described above. That feedback back causes the circuit 120 to shut off the power to the motor driven operator and in turn supply power to the lock 10 (in an appropriate sequential manner as previously described if more than one lock is provided).

The paddle switch 100 may thus be used to particular advantage by shutting off the operator before its gears incur the higher loading which typically occurs during the last part of the closing motion of the sash 16 (when the sash 16 is biased against the weather strip typically provided around the jamb 12).

It should be understood, however, that many of the advantages of the present invention could be obtained with still other control circuits. For example, the paddle switch 100 could be omitted to reduce costs and a current trip (i.e., overload on the operator motor) instead be sensed to indicate that the power should be switched to the lock 10 once the operator has shut the sash 16 against the jamb 12. Further, the lock 10 could be used in an installation having a manual operator for moving the sash 16, with the lock 10 simply being actuated by the paddle switch 100 when the keeper 14 enters the keeper receiving chamber 32. Alternatively, the paddle switch 100 could be omitted and the lock 10 used in combination with a manual operator (or even no particular operator), with the lock 10 being actuated by a separate manual control switch.

Figure 3:
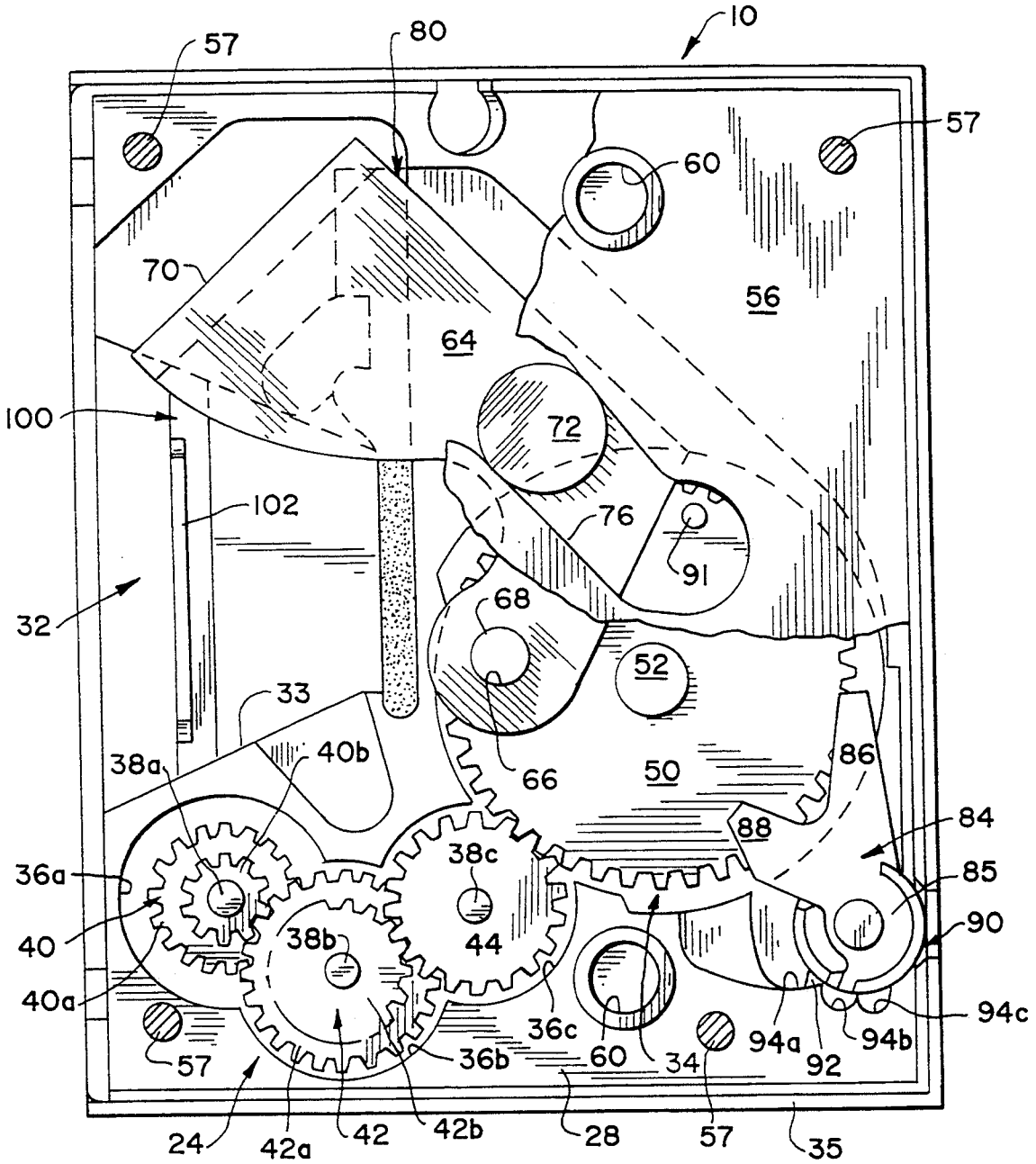
FIG. 3 is a bottom view of the lock of the present invention, with the bottom plate partially broken away, showing the lock in its open position.

In any event, as the keeper 14 approaches the open lock 10, the pawl 64 is to the side of the keeper receiving chamber 32 as shown in FIG. 3.

Figure 4:
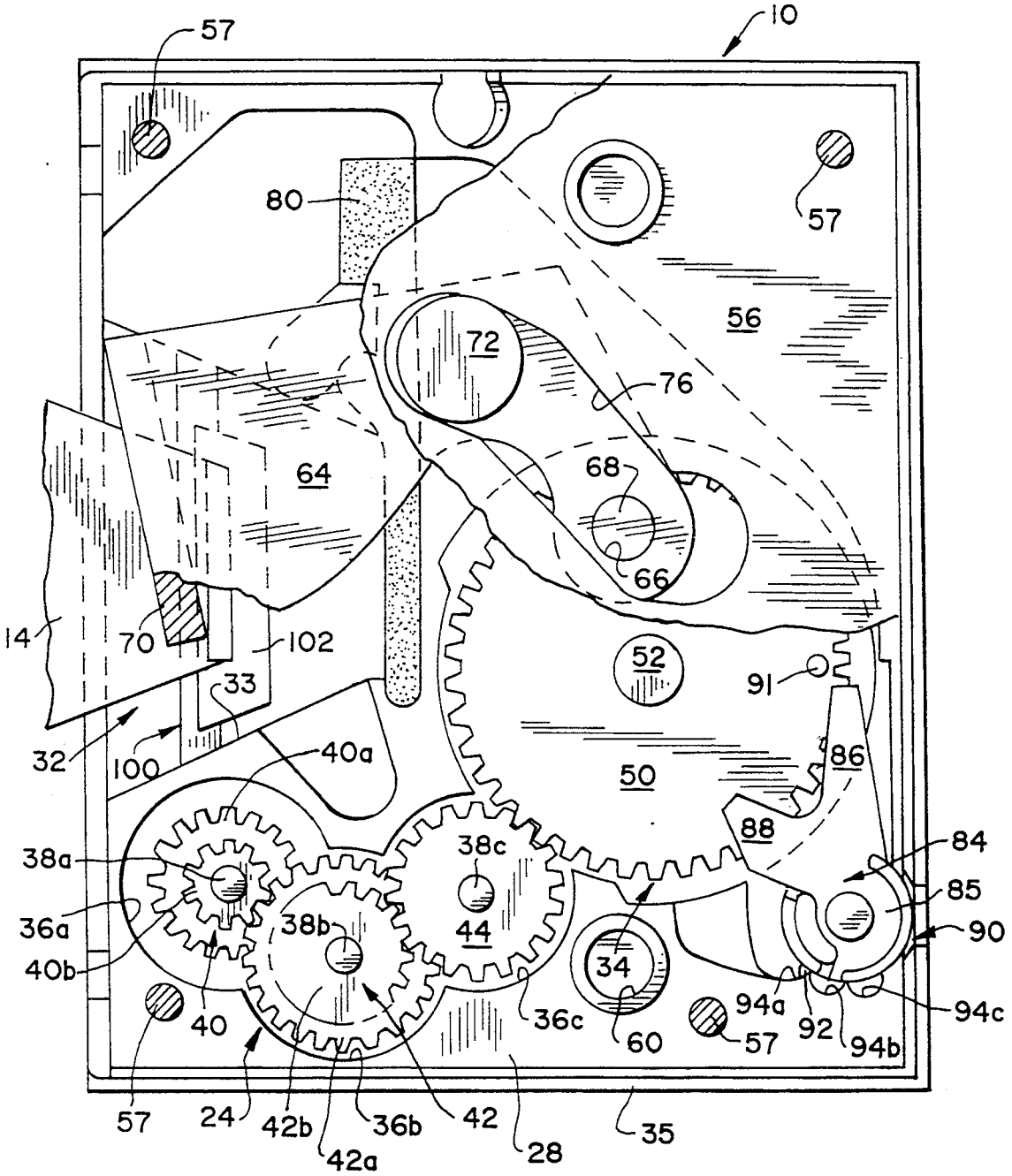
FIG. 4 is a view similar to FIG. 3, but showing the lock in an intermediate position with the lock moving from its open position to its locking position.

Once the keeper 14 enters the lock and trips the paddle switch 100, the lock motor 20 is actuated as previously described and the drive gear 50 pivoted clockwise as viewed from the bottom of the lock 10 and as shown in FIG. 4. The combined motion of the pivot pin 52 on the drive gear 50 and the guide pin 72 in the guide slot 76 moves the pawl keeper grasping portion 70 in front of the keeper 14 to thereby block the keeper 14 from leaving the lock 10 (effectively locking the sash 16 to the jamb 12).

Figure 5:
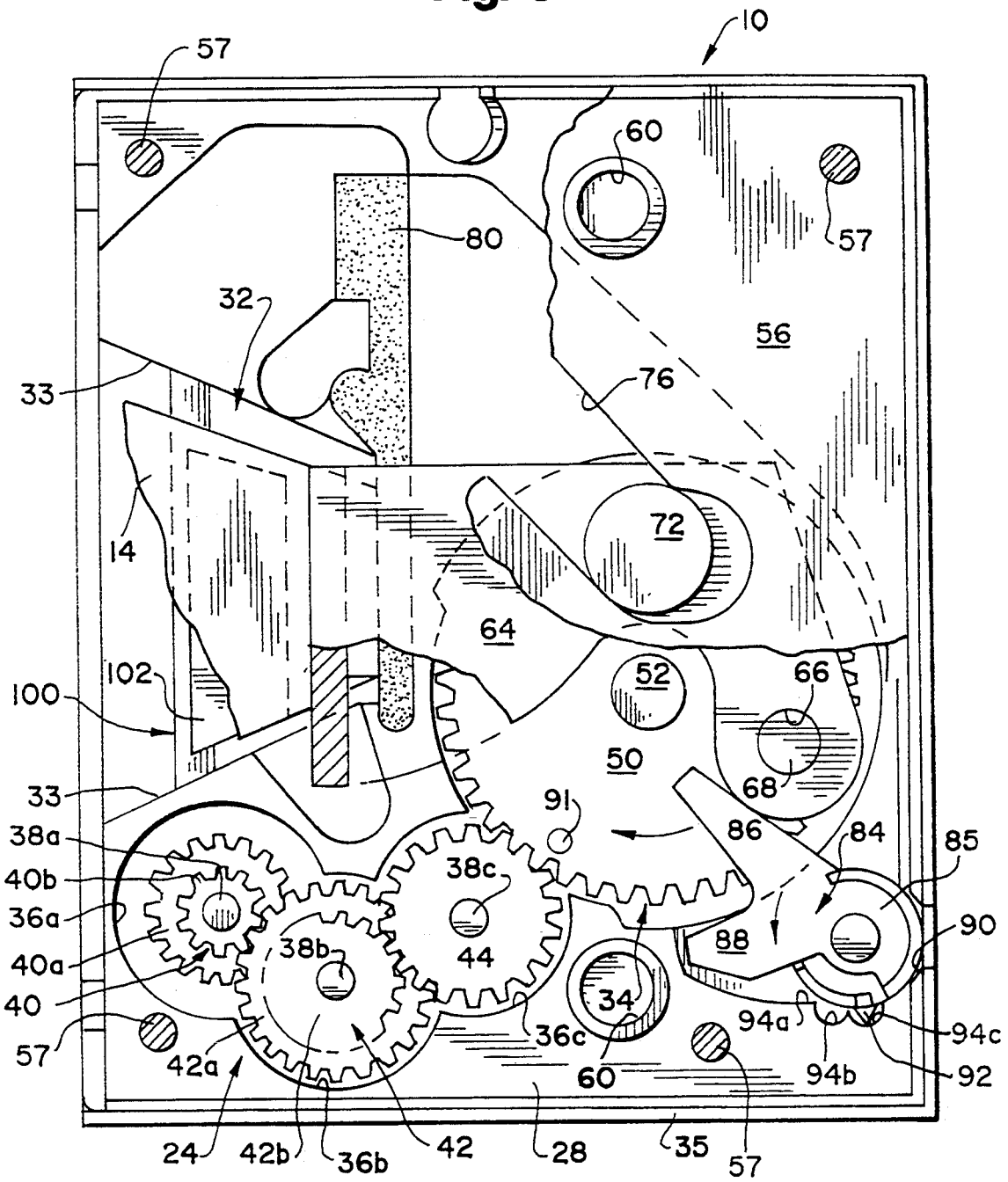
FIG. 5 is a view similar to FIG. 3, but showing the lock in its locking position.

Further clockwise movement of the drive gear 50 pulls the pawl 64 further to the locking position shown in FIG. 5 to not only securely lock the sash 16 to the jamb 12, but also to ensure that the sash 16 is pulled fight against the jamb 12 to provide the desired weather seal against drafts, leaks, heat loss, etc. A current trip or other suitable feedback can be used to detect when the lock 10 has suitably tightened the sash 16 against the jamb 12 and therefore shut off the current to the motor 20.

In the locking position, the pawl 64 is preferably oriented so that the plane defined by the axes of the drive gear pivot pin 52 and the pawl pivot pin 68 passes essentially through the center of the portion of the keeper 14 grasped by the pawl 64. As a result, forces resulting from an attempted forced opening of the sash 16 would have minimal tendency toward pivoting of the drive gear 50. That is, forced opening is resisted principally by the strength of the pawl 64, drive gear 50, and drive gear pivot pin 52, with minimal pivoting force being transmitted to the drive 24. Therefore, stresses to the drive 24 and motor 20 are substantially eliminated, and their useful life can be maximized.

The above described movement of the lock 10 from the open to locking positions also operates the indicator 84 in a two step manner. Specifically, during initial movement of the drive gear 50, the indicator 84 remains unchanged with the portion of its hub 85 indicating that the lock 10 is open (conventionally, a red colored portion) adjacent the base window opening 90, and the detent 92 in the associated detent notch **94*a* (see FIGS. 3 and 4**).

Continued clockwise pivoting of the drive gear 50 moves the indicator pin 91 into the notch between the indicator legs 86, 88, with still further pivoting causing the pin 91 to pivot the indicator from its open position to an intermediate position with the detent 92 in the middle detent notch **94*b*. In the preferred embodiment of the present invention, in the intermediate indicator position, continued movement of the pin 91 with the drive gear 50 will no longer move the indicator 84 because the leg 88 being driven has pivoted out of the continuing path of the pin 91. Rather, movement of the indicator 84 from the intermediate position to the locked position (with the detent 92 in the third detent notch 94*c*) is accomplished through engagement of the pivoted end of the pawl 64 with the other indicator leg 86 as best seen in FIG. 5. In this locked position, a different portion of the indicator hub 85 indicating that the lock 10 is in a locking position (conventionally, a black colored portion) is adjacent the base window opening 90**.

The intermediate position of the indicator is a significant safety and operational feature for the lock 10 of the present invention. That is, since motor driven locks 10 are driven without direct contact by any person, it is easier for the lock to fail without a person feeling it or otherwise noticing the failure. In fact, such a failure could continue over a long period of time without being noticed. By requiring that the pawl 64 itself be moved into the locking position in order to get the indicator 84 to the lock position, the indicator 84 will therefore not be able to give a false reading if the pawl 64 should fail to pivot properly to its locking position. Rather, in such a failed condition, the indicator 84 will show half of both visually different portions (i.e., half red and half black) through the window opening 90 to clearly indicate that the lock 10 requires checking.

When it is thereafter desired to open the window sash 16, the control circuit 120 would be suitably signaled to reverse the motor 20 to reverse operation of the lock drive. Therefore, the drive gear 50 is then pivoted counterclockwise (see FIG. 6) to move the pawl 64 and release the keeper 14. Due to the path of the keeper grasping portion 70 of the pawl 64, the keeper 14 is pushed out a slight amount by the pawl 64 during initial opening, such kick out thus helping break the weather stripping seal between the jamb 12 and the sash 16 and thereby reduce stress on the operator which thereafter functions to open the sash 16.

Figure 6:
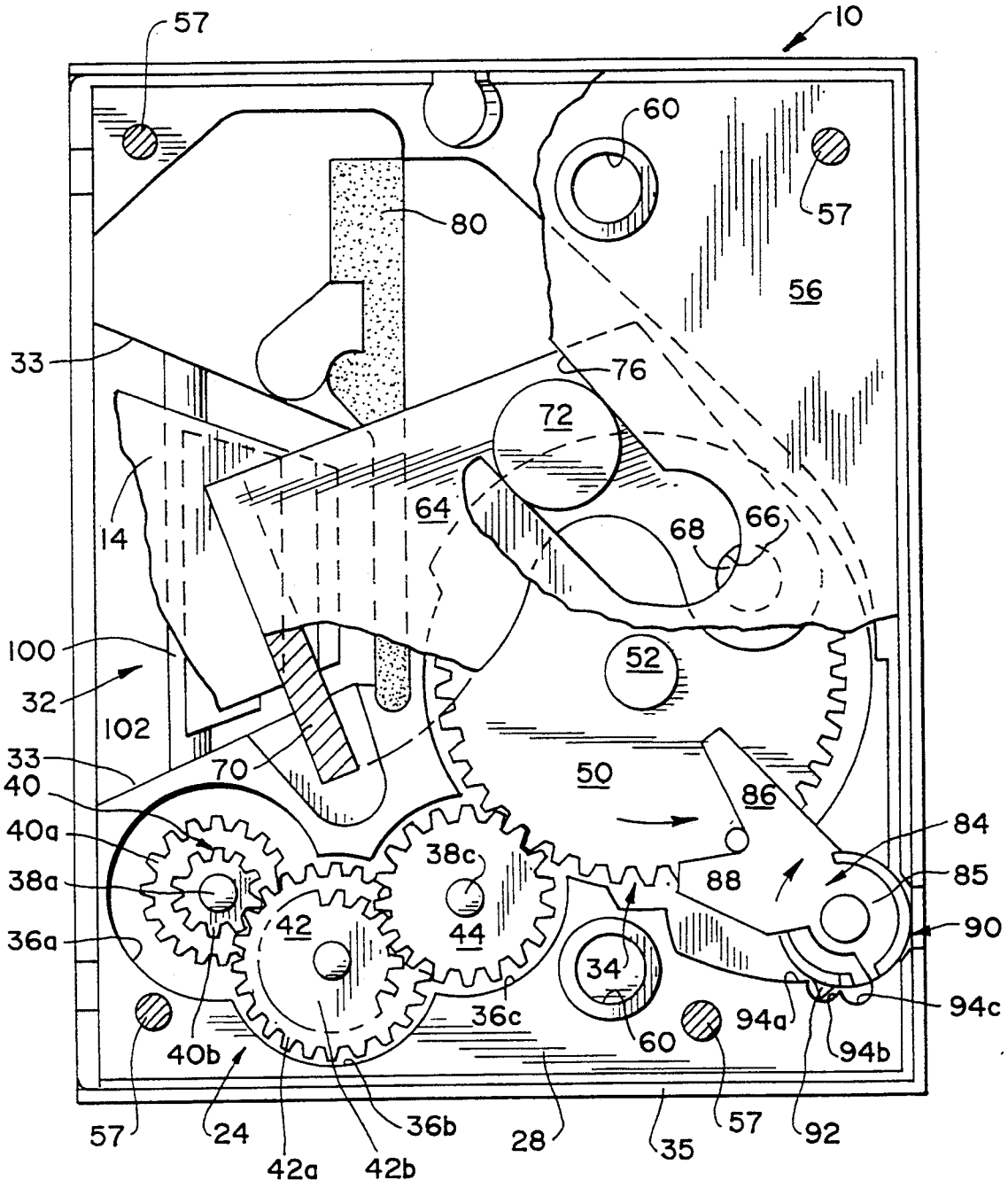
FIG. 6 is a view similar to FIG. 3, but showing the lock in an intermediate position with the lock moving from its locking position to its open position.
Figure 7:
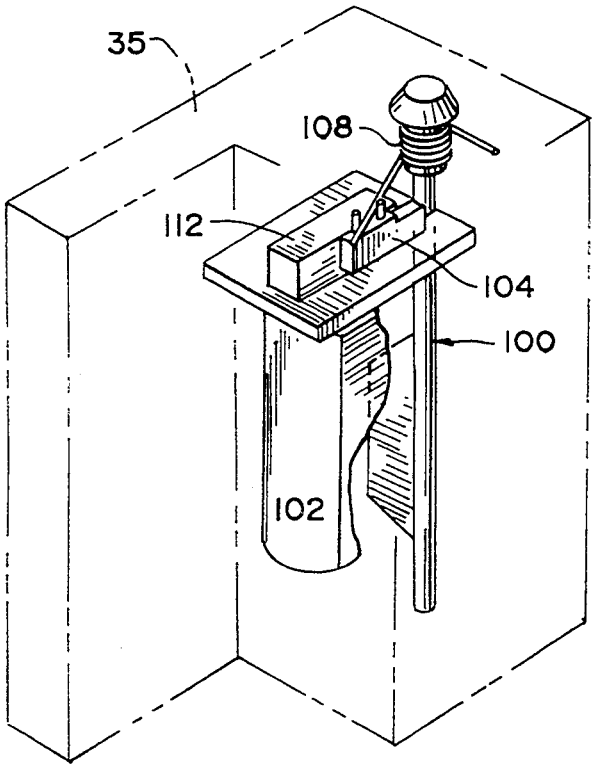
FIG. 7 is a broken view of the lock of the present invention showing the paddle switch with the window sash spaced from the window jamb.

As best seen in FIG. 6, the indicator pin 91 in such operation once again engages in the notch of the indicator 84 and acts against the indicator leg 86 to move the indicator 84 from the lock position through the intermediate position to the open position. (Note that, given the above described operation of the indicator during locking, the lock would not give a false reading during opening even in the event of failure on that cycle, since the indication that the lock is open would be correct. In the next locking operation the indicator 84 would give an indication of the failure by showing the mixed indication [red and black] in the window opening 90 to warn that the lock 10 may not actually be in the locking position.)

When the pawl 64 reaches the open position (see FIG. 3), it compresses the stop 80 and is ultimately stopped sufficiently to provide suitable feedback (such as a current trip) to the control circuit 120 which then shuts off the power to the motor 20 and, where appropriate, supplies power to a suitable window operator to then open the window sash 16.

It should thus be apparent that a lock which incorporates the above described features may be easily manufactured and assembled, and easily installed in both retrofit and new construction installations. Further, such a lock will provide simple, smooth, strong, reliable and automatic operation over the long desired life of a window unit. Still further, while requiring minimal individual interaction to control the lock, the lock condition may be readily determined by any individual, including determination of any failure of the lock. Also, the lock can be readily used in combination with any number of window sash operators, and may be used to particular advantage in combination with any number of motor driven operators and a wide variety of control circuits, not only in providing ease of operation but also in working with the operators to help to extend the life of the operators.

Still other aspects, objects, and advantages of the present invention can be obtained from a study of the specification, the drawings, and the appended claims.

I claim:

1. A lock mountable on a window jamb for selectively grasping a keeper on a window sash to secure a sash closed against a jamb, comprising:

a lock base with an open interior space for mounting to a jamb, said base including a visible window opening therein;

a pawl movable between an open position clear of a keeper disposed in said base open interior space and a locking position for grasping a keeper when a sash is closed against a jamb;

an indicator having two visually different portions, one of said portions being visible through the window opening in a first position of the indicator and the other of said portions being visible through the window opening in a second position, said indicator being moved between said first and second positions when said pawl is moved between said open and locking positions;

a drive gear connected to said pawl for moving said pawl between the open and locking positions;

means for pivoting said drive gear about a first axis; and a pin on said drive gear, said pin engaging said indicator to at least partially move said indicator during at least one part of the movement of said pawl between its open and locking positions.

2. The lock of claim 1 wherein:

said indicator is pivotable within the lock base about a second axis and further includes a notch; and said pin is received in said notch and pivots said indicator during said at least one part of said pawl movement.

3. The lock of claim 2, wherein:

said indicator is in said first position when said pawl is in one of said locking or open position; and said pin disengages from said notch during movement of said pawl away from said one position when said indicator is between said first and second positions; and further comprising a cam portion on said pawl engaging said indicator during the other part of the movement of said pawl from its one position to its other position to move said indicator completely to said second position.

4. The lock of claim 3, wherein said one position of said pawl is the open position and said other position of said pawl is said locking position.

5. A lock mountable on a window jamb for selectively grasping a keeper on a window sash to secure a sash closed against a jamb, comprising:

a lock base for mounting to a jamb and including a visible window opening therein, said base defining an open interior space along one side of said base adapted to receive a keeper secured to a window sash when a sash is closed against a jamb;

a drive gear pivotable within said open interior space about a first axis;

a motor mounted to said lock base and drivably connected to said drive gear for pivoting said drive gear about the first axis;

a pawl secured to said drive gear for movement between an open position clear of a keeper disposed in said base open interior space and a locking position for grasping a keeper disposed in said base open interior space;

means for actuating said motor to move said pawl from the open position to the locking position in response to movement of a keeper into the base open interior space; and an indicator having two visually different portions, one of said portions being visible through the window opening in a first position of the indicator and the other of said portions being visible through the window opening in a second position, said indicator being moved between said first and second positions when said pawl is moved between said open and locking positions.

6. The lock of claim 5, further comprising a pin on said drive gear, said pin engaging said indicator to at least partially move said indicator during at least one part of the movement of said pawl between its open and locking positions.

7. The lock of claim 6, wherein:

said indicator is pivotable within the lock base about a second axis and further includes a notch; and said pin is received in said notch and pivots said indicator during said at least one part of said pawl movement.

8. The lock of claim 7, wherein:

said indicator is in said first position when said pawl is in one of said locking or open positions;

said pin disengages from said notch during movement of said pawl away from said one position when said indicator is between said first and second positions;

said pawl is secured to said drive gear at one end for pivoting about a third axis spaced from and substantially parallel to said first axis, said pawl having a keeper grasping portion at its other end; and said pawl one end engages said indicator during the other part of the movement of said pawl from its one position to its other position to move said indicator completely to said second position.

9. The lock of claim 8, wherein said one position of said pawl is the open position and said other position of said pawl is said locking position.

10. The lock of claim 5, wherein said indicator is in said first position when said pawl is in said open position and said indicator is in said second position when said pawl is in said locking position, and said one indicator portion is red.

11. The lock of claim 5, wherein said actuating means comprises:

a movable paddle within the lock base open interior space, said paddle being moved when engaged by a keeper; and a switch operably connected to said paddle whereby said switch provides feedback to actuate power to said motor to move the pawl to the locking position when said paddle is engaged by movement of a keeper into said base open interior space.

* * * * *